United States Patent [19]

McHenry

[11] 3,953,064

[45] Apr. 27, 1976

[54] GATE LATCH

[76] Inventor: Warren B. McHenry, 5316 Crittenden St., Hyattsville, Md. 20781

[22] Filed: Mar. 25, 1975

[21] Appl. No.: 561,841

[52] U.S. Cl. ..... 292/184; 292/153

[51] Int. Cl.[2] ..... E05C 1/06

[58] Field of Search ..... 292/184, 189, 151, 153, 292/150, 154, 131, 136, 108

[56] References Cited

UNITED STATES PATENTS

| | | | |
|---|---|---|---|
| 97,934 | 12/1869 | Large | 292/184 |
| 727,494 | 5/1903 | Thompson | 292/189 |
| 995,232 | 6/1911 | Edgar, Sr. | 292/189 |
| 1,131,403 | 3/1915 | Matthews | 292/189 |
| 1,260,469 | 3/1918 | Smith | 292/153 |
| 2,641,494 | 6/1953 | Burris | 292/189 |

*Primary Examiner*—James T. McCall
*Assistant Examiner*—Terrell P. Lewis

[57] ABSTRACT

A gate latch suitable for sliding and swinging doors which includes a vertically sliding self-engaging bolt, and a manually positioned bolt blocking member. The latch is particularly applicable for installation in doors of animal pens.

8 Claims, 2 Drawing Figures

8
7
1
23
20
15
14
21
5
22
26
12
25
30

10
9
8
3
2
13
30
1
12
6
7
15
4
5
2
2
16
18
17

GATE LATCH

This invention relates to door latches, and more specifically to an improved self-engaging positive locking door latch that is simple and dependable in operation and which may be readily installed in both hinge and sliding type doors.

The prior art discloses many types of self-engaging door latches. Typically, the latches which are currently available utilize horizontal sliding bolts which engage a strike plate which is normally recessed in the door frame. Latches are also available which comprise a surface mounted, self-closing latch which engages a strike bar which extends a substantial distance from the edge of the door or from the door jamb surface.

These prior art latch devices possess inherent drawbacks in that the sliding bolt-recessed strike device is frequently difficult to install in gates which are fabricated from metal. Furthermore, surface mounted latches used in conjunction with relatively long bar type strikers present a safety hazard when the strike bar extends into door openings or passageways.

It is therefore an object of the present invention to provide an improved gate latch device which may be quickly and economically installed on both new and existing gates.

It is a further object to provide a gate latch which may be surface mounted on both swinging and sliding gates.

It is a further object to provide a self-closing gate latch which presents a low mounting profile and which may be installed with a minimum of fitting and fasteners, and without fusion attachment.

It is a further object to provide a gate latch which is simple in operation and rugged in construction.

Figure 2:
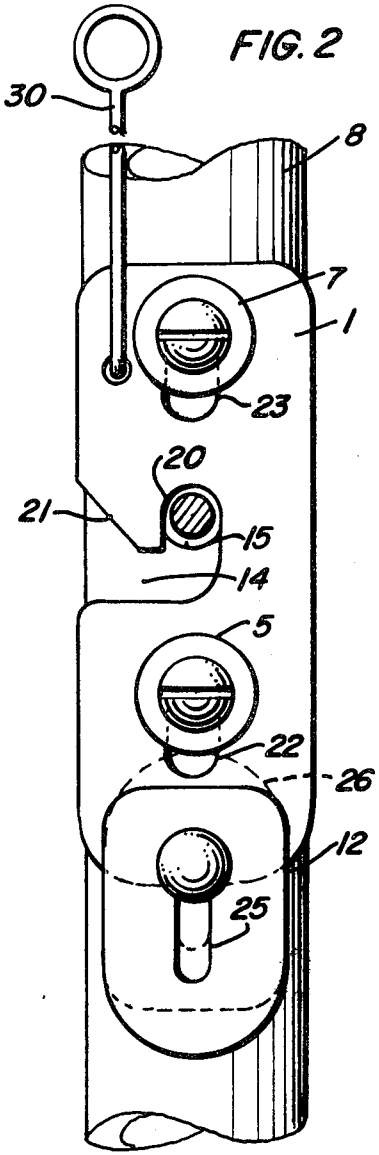
Figure 1:
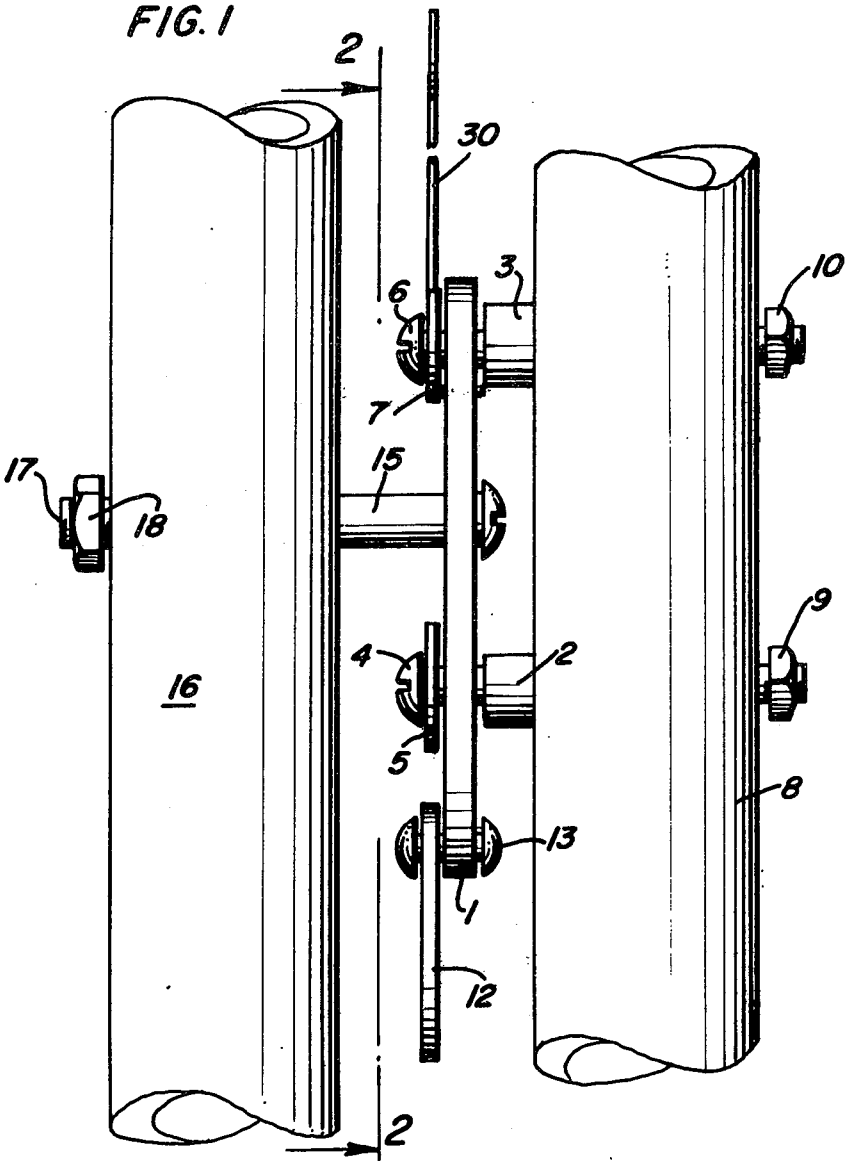

These and still further objects of the present invention will become readily apparent to one skilled in the art in the following detailed description and drawing wherein:

FIG. 1 is a plain view of a latch which embodies the teachings of the present invention; and FIG. 2 is a cross-sectional view of the latch of FIG. 1 taken along line A—A.

Broadly, my invention contemplates a latch wherein a vertically sliding bolt is engaged by a horizontal strike stud, and a selectively positioned bolt blocking plate is mounted on the bolt to prevent undesired opening of the latch.

A more comprehensive understanding of my invention may be obtained by reference to the drawings, wherein FIG. 1 discloses a latch of the present invention mounted on a door and frame constructed of pipe. Specifically, in FIG. 1 a vertically mounted sliding bolt 1 is maintained in a vertical position by means of mounting bushings 2 and 3 and by means of screws and washers 4 and 5, and 6 and 7 respectively. It is noted that the mounting screws 4 and 6 extend through the pipe frame member 8 and are affixed thereto by means of nuts 9 and 10. The sliding bolt 1 is provided with a blocking plate member 12 which is affixed to the bolt 1 by means of rivet 13.

The sliding bolt 1 is engaged by a strike stud 15 which is affixed to the door frame member 16 by means of bolt and nut 17 and 18.

As shown in FIG. 2, the sliding bolt 1 is provided with a strike engaging slot 19 which is L shaped to include a strike engaging surface 20. The strike engaging slot is also provided with an inclined strike engaging surface 21.

The sliding bolt 1 as shown in FIG. 2 is mounted on the gate frame member 8 by means of mounting bushings 2 and 3 which extend through elongated holes or slots 22 and 23. The elongated slots 22 and 23 are fabricated with sufficient clearance around the mounting bushings 2 and 3 to permit free vertical movement of the bolt 1 to operate upon impact with strike stud 15 and free fall when engaged. The bolt 1 is also provided with the blocking plate member 12 which is mounted to the bolt by means of rivet 13 which extends through an elongated hole or slot 25. The clearance between the rivet 13 and the slot 25 is sufficient to permit both sliding and rotation of the plate 12 about the rivet 13. The bolt 1 is also provided with a lifting handle 30.

In operation, the bolt 1 engages the strike stud 15 by initial contact with the inclined surface 21 of the strike engaging slot 19. The strike stud 15 exerts an upward force on the sliding bolt 1 as the bolt and stud are moved relative to each other on a horizontal plane. As the movement relative to the strike 1 and stud 15 progresses, the bolt 1 is lifted over the stud 15 whereupon the bolt drops in a vertical direction to engage the stud 15 and the bolt stud engaging surface 20. When the bolt 1 slides downward over the stud 15, the latch is in the closed or latched position.

When bolt 1 is in the latched position it is retained in that position by gravity until a lifting force is exerted through the handle 30. If it is desired to block the bolt 1 in the latched position, the blocking plate 12 is rotated about the rivet 13 to permit the blocking plate to slide the length of the elongated hole and present the rounded surface of the blocking plate 12 in an upward position as indicated by broken line 26. When the sliding blocking member 12 is in the position shown by broken line 26, the upper edge thereof engages the edge of washer 5 and thereby prevents upward movement of the bolt 1. It is also noted that the blocking plate 12 may be mounted on the opposite side of the bolt 1, whereupon when placed in the blocking position the top surface of plate 12 will engage the lower surface of the bushing 2. It is seen that the blocking member 12 is fabricated so that the blocking member, when in a vertical position, either in the blocking or non-blocking position, will possess a center of gravity lower than that of mounting rivet 13. Therefore, it is seen that the blocking plate 12 is retained in either the blocking or non-blocking position by gravitational force.

As shown in the present drawing, the latch mechanism contemplated herein is affixed to pipe members 8 and 16 which are used in the construction of a typical gate and frame used to construct a variety of enclosures, such as animal pens. In particular the latch is suitable for use in primate pens. While the drawing shows the present latch mounted on pipe type members, it should be understood that the latch may be readily adapted for installation on doors and frames constructed of wood and other material. It is noted that the strike stud 15 is quickly mounted on the pipe member 16 by means of a single bolt. The strike member 15 may be conveniently constructed by means of a spacer through which is placed a bolt, or alternatively the strike member may be constructed as a single piece. The vertical bolt member 1 is slidably retained on the mounting bushings 2 and 3 by means of the slots 22 and 23 which are provided with sufficient clearance to permit easy motion of the bolt with respect to the bushings 2 and 3. Construction of the bushing members 2 and 3 is conventional and may conveniently comprise separate spacer members retained by bolts 4 and 6. Retention of the sliding bolt 1 on the bushing members 2 and 3 is assured by means of washers 5 and 7. However, it is contemplated that obvious variations in construction may eliminate the need for the washers 5 and 7.

It should be noted that the present latch may be mounted with the bolt either to the stationary frame which surrounds a gate, or the bolt may be mounted on the moving gate. It is seen that the present latch device may be advantageously used in conjunction with sliding gates typically found in animal pen construction. Likewise, the present latch may be used in the construction of swinging gates which are found in numerous enclosures.

The above description clearly sets forth a novel and useful gate latch mechanism which is simple to operate and which may be easily constructed from inexpensive, durable materials.

I claim:

1. A latch which comprises a. a sliding bolt normally maintained in closed position, said bolt having an inclined strike engaging surface;

b. a strike means adapted to engage said inclined surface and move said bolt to an open position and permit engagement of said strike means in a locking slot in said bolt;

c. a guide means adapted to guide said bolt to open/-closed positions, said guide means including a plurality of elongated holes in said bolt and mounting bushing slidably passing therethrough; and d. a bolt blocking means slidably and rotatably fixed to said bolt and being adapted to slide and rotate to selected blocking and non blocking positions.

2. The latch of claim 1 wherein said blocking means includes a plate member having an elongated hole therethrough affixed to said bolt by a stud passing through said hole.

3. The latch of claim 2 wherein said blocking means engages one of said bolt mounting bushings in the blocking position.

4. The latch of claim 2 wherein the center of gravity of said blocking means is below the affixing stud when said blocking means is in the blocking and non-blocking positions.

5. The latch of claim 1 wherein the said bolt is mounted to slide substantially vertically upon engagement with said strike means.

6. The apparatus of claim 5 wherein said bolt is provided with a handle means to move said bolt from a lower engaged position to an unlatched position.

7. The latch of claim 1 attached to a sliding gate.

8. The latch of claim 1 attached to a swinging gate.

* * * * *